US008403070B1

(12) United States Patent
Lowe

(10) Patent No.: US 8,403,070 B1
(45) Date of Patent: Mar. 26, 2013

(54) AUTOMATED EXTERIOR FIRE PROTECTIVE SYSTEM

(76) Inventor: Ryan Lowe, Maricopa, AZ (US)

( * ) Notice: Subject to any disclaimer, the term of this patent is extended or adjusted under 35 U.S.C. 154(b) by 812 days.

(21) Appl. No.: 12/589,037

(22) Filed: Oct. 16, 2009

(51) Int. Cl.
*A62C 8/00* (2006.01)

(52) U.S. Cl. ..... 169/48; 169/16; 169/49; 169/51; 169/70; 52/23

(58) Field of Classification Search ..... 169/16, 169/48, 49, 51, 70; 52/23, 83
See application file for complete search history.

(56) References Cited

U.S. PATENT DOCUMENTS 1,936,732 A * 11/1933 Renard ..... 52/741.3
3,715,843 A 2/1973 Ballinger
3,877,525 A 4/1975 Husson et al.
4,033,367 A * 7/1977 Johnston ..... 135/100
4,858,395 A 8/1989 McQuirk
5,423,150 A 6/1995 Hitchcock
5,608,992 A 3/1997 Floyd
5,829,200 A 11/1998 Jones et al.
6,742,305 B2 6/2004 Rogers et al.
6,945,468 B1 * 9/2005 Rodriguez et al. ..... 239/17

* cited by examiner

*Primary Examiner* — Dinh Q Nguyen
(74) *Attorney, Agent, or Firm* — Patent Law & Venture Group; Gene Scott

(57) ABSTRACT

A cover system and method of automated deployment for protecting structures from fire dangers uses water pressure to force fire resistant rolls and folded arrangements of materials to deploy when a water valve is triggered by high heat. Water then is forced through sprinkler hoses on the interior of the deployed materials to maintain a wet condition on the interior surface of the deployed covers and also on the exterior of the building that is being protected. The water is collected in pockets of the deployed material which anchors it in place and pumps within the pockets return the water to a distribution manifold on the roof of the structure.

5 Claims, 5 Drawing Sheets

AUTOMATED EXTERIOR FIRE PROTECTIVE SYSTEM

BACKGROUND OF THE INVENTION

1. Field of the Present Disclosure

This disclosure relates generally to automated fire safety systems such as sprinkler systems which protect against fires that start within interior spaces of buildings; and more particularly to an automated protective system directed to the dangers posed by fires originating from the exterior of structures.

2. Description of Related Art Including Information Disclosed Under 37 CFR 1.97 and 1.98

Many structures are lost each year from external fire causes. Structures that are damaged are often those in high risk environments where very large or very fast moving wild fires are common. Typically, losses occur in areas at the interface of undeveloped land and urban areas and where hilly terrain complicates fire protection measures and existing fire fighting capabilities may be inadequate. Therefore, it has been recognized that buildings in high risk areas need to have built-in self-protection akin to the widely employed automatic fire sprinkler systems. The direction of the prior art is to provide portable or add-on covering systems that are themselves fire resistant or fire-proof. These ideas include covering the exterior of a building so that heat and flames are not able to contact the structure. Several approaches to accomplish this are defined in the prior art as shown by the following patent disclosures.

Ballinger, U.S. Pat. No. 3,715,843 discloses a fire protection apparatus including fire retardant blankets and panels applied to and secured about a building by straps and ground inserted hold-down members requiring substantial time consuming manual installation effort.

Husson et al., U.S. Pat. No. 3,877,525 discloses roller mounted screens, each fitted with a weight, to extend the screen by gravity with provision made for applying a fire retardant to the screen during extension. The system is for internal installation within a building and does not appear to readily lend itself to protection of a building exterior.

McQuirk, U.S. Pat. No. 4,858,395 discloses fire resistant sheets stored as rolls within roof mounted housings. The rolled sheet material is extracted by manually pulled ropes with certain sheets having a folded portion intended for, when unfolded, overlying the end wall of a house. The ground contacting edges of certain sheets may be provided with a bar to enhance ground engagement. The problem of manually extracting fire resistant sheets in the presence of an advancing brush fire, often accompanied by high winds, would seem to hinder use of the patented fire protection system.

Hitchcock, U.S. Pat. No. 5,423,150 discloses an automatically deployed fire resistant blanket by use of projectiles propelling blanket extremities. No provision is made for firmly securing the blanket about the building structure being protected in a snug manner nor would the system appear to be feasible in the presence of strong winds which often are present in fast moving wildfires.

Floyd, U.S. Pat. No. 5,608,992 discloses a fire isolation device for a free standing structure. This device includes a left tarp and right tarp fabricated from a fire resistant material. The left tarp and right tarp are of a size to completely enclose the free standing structure. Attached to the left tarp and right tarp is a support structure, which is capable of moving from an upward position where the left tarp and the right tarp completely enclose the free standing structure to a downward position where the left and right tarp expose the free standing structure. This device also includes a moving mechanism for moving the plurality of support members from the downward position to the upward position.

Jones et al., U.S. Pat. No. 5,829,200 discloses fire retardant blankets normally stowed within housings in place on a building roof structure or below a roof eave. Cables extract the blankets for deployment over the roof. Fire retardant wall blankets stowed in housings adjacent to roof eaves are deployed by gravity.

Rogers et al., U.S. Pat. No. 6,742,305 discloses a series of easily deployed; pre-fitted covering material segments which when joined together envelop an entire structure. This covering is secure enough to last in a deployed position indefinitely, and is retractable and reusable for many years. It is attached to a structure for immediately available deployment at any time.

In the above disclosures it is noted that several important problems are not well addressed and these problems will now be described. A building made of concrete with no openings for doors or windows will survive a high temperature fire for a significant period of time. However, practical residential and commercial buildings of less durable materials and which do have doors and windows cannot survive the temperatures and flame contact of wild fires for more than a few minutes. Also, fire brands find relatively easy access into the interior of structures through their ventilation system's screens, louvers and such.

It is clear that a solution to this problem must include preventing high temperatures, flames and fire brands from impinging on exterior surfaces of structures and the notion of removable structure covers is palpable. However, a major problem with covers is that fire resistant materials tend to break down rather quickly when exposed to high temperatures. Another problem is that covers tend to degrade the appearance of building structures. A third problem is that no practical automated deployment scheme has been devised. Automated deployment is necessary especially for structures that are in isolated area or which are not occupied, and certainly when a structure is in the path of a fast moving wildfire.

The present invention addresses these three problems providing: a means for storing covering materials on buildings without too adversely affecting their appearance, a means for automatically effectively deploying the coverings, and a means for preventing the coverings from failing in the face of impinging fires.

BRIEF SUMMARY OF THE INVENTION

This disclosure teaches certain benefits in construction and use which give rise to the objectives described below.

The presently described invention is a cover system and method of deployment that provides for automated protection of a building structure when an external fire danger is present. Water pressure is used to force fire resistant rolls and folded arrangements to deploy when a water valve is triggered by high heat. Water then is forced through sprinkler hoses on the interior of the deployed materials to maintain a wet condition on the interior surface of the deployed covers and also on the exterior of the building that is being protected. The Water is collected in hems of the deployed material which anchors it in place and pumps within the hems returns the water to a manifold on the roof that is fed by a source of water under pressure.

A primary objective inherent in the above described apparatus and method of use is to provide advantages not taught by the prior art.

Another objective is to provide a fire resistant cover on a building when fire danger appears.

A further objective is to provide such a cover that is automatically unfurled when high temperature is sensed.

A further objective is to maintain water spray on both cover and building during the fire danger.

Other features and advantages of the present invention will become apparent from the following more detailed description, taken in conjunction with the accompanying drawings, which illustrate, by way of example, the principles of the presently described apparatus and method of its use.

BRIEF DESCRIPTION OF THE SEVERAL VIEWS OF THE DRAWING(S)

Illustrated in the accompanying drawing(s) is at least one of the best mode embodiments of the present invention In such drawing(s):

DETAILED DESCRIPTION OF THE INVENTION

The above described drawing figures illustrate the present invention and its method of use in preferred embodiments, which are further defined in detail in the following description. Those of ordinary skill in the art may be able to make alterations and modifications to what is described herein without departing from the spirit and scope of this invention. Therefore, it should be understood that what is illustrated is set forth only for the purposes of example and should not be taken as a limitation on the scope of the present apparatus and its method of use.

Details relating to the construction and deployment of preferred features and methods of the present invention are found in the above summarized reference to McQuirk, U.S. Pat. No. 4,858,395, which teaches fire resistant sheet materials that may be stored in a folded or rolled state and hidden from sight within a roof mounted, architecturally pleasing, housing with spring loaded doors, and also Jones et al, U.S. Pat. No. 5,829,200 which teaches handing rolled materials for deployment on buildings and in such applications where a peaked roof is not available, the relevant disclosures of these documents are included by reference thereto as if fully set forth herein.

Figure 1:
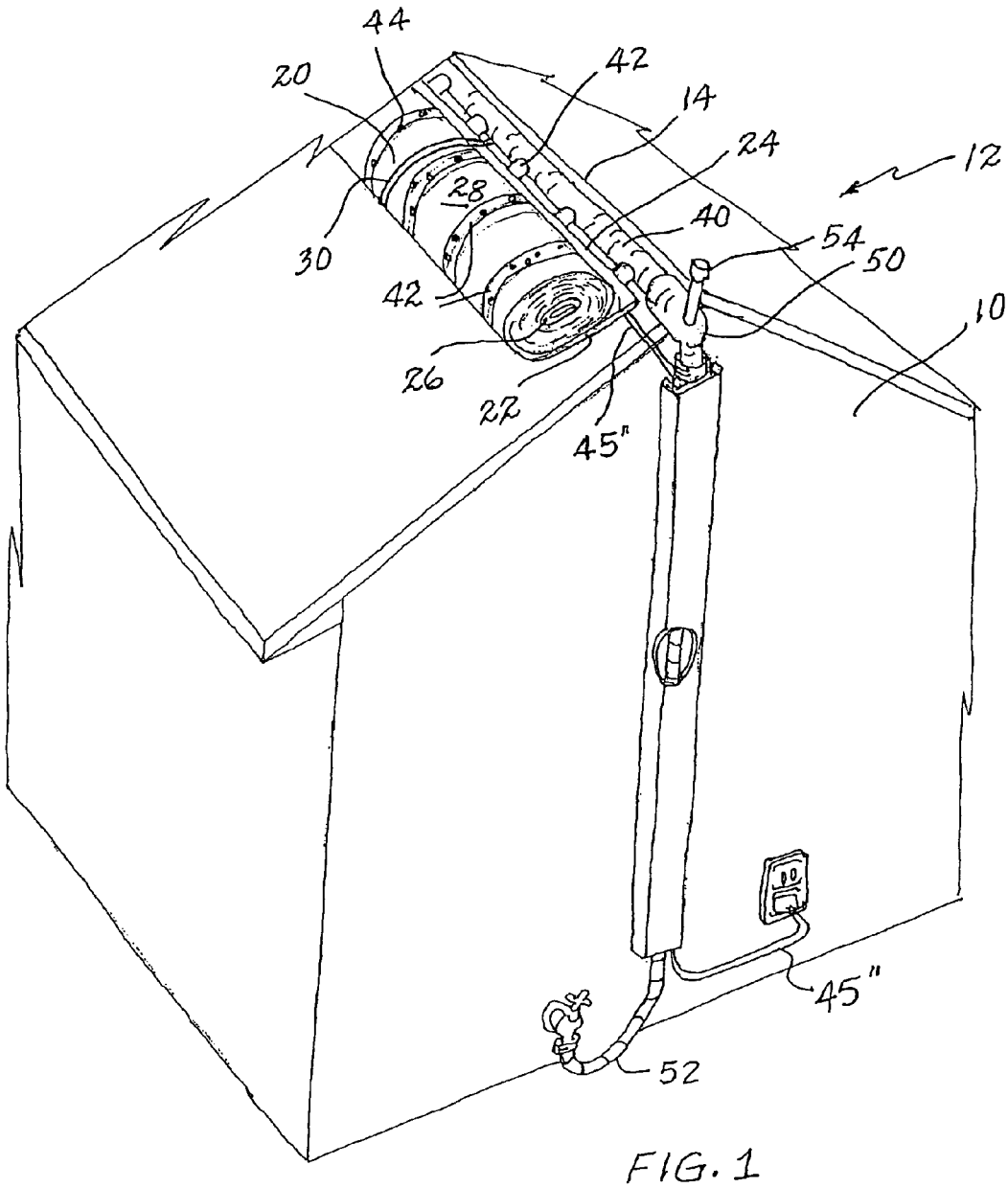
FIG. 1 is a perspective view of a portion of a building showing the presently described apparatus in its retracted nominal state.

As shown in FIG. 1 a typical building that may be protected by the present invention has a peaked roof, and provides a source of water flowing under pressure, and a source of electrical power. Almost all modern residential buildings have outside water bibs and electrical outlets so that the present invention may be easily installed and operated in these structures. Where a pressurized water bib or a live electrical outlet is not readily available, such utilities may usually be provided by a nearby source. A peaked roof provides a site for storing the invention out of sight, that is, above the line of sight of a person on the ground. The peaked roof also provides an angled surface, the roof surface itself, allowing the deployment of a key component of the invention, a material roll, by utilizing the effect of gravity for unrolling the material. For buildings with flat roofs, the invention may be deployed in alternative ways as shown by Jones et al.

FIG. 1 shows the present invention in one embodiment where it is installed on a building 10 having a peaked roof 12. In this and the other figures referred to herein, only a portion of the building structure is shown while other portions of the building structure are cut away. However, it will be realized that the invention as shown may be replicated on other portions of a building so that the present disclosure is exemplary of an apparatus and a method that may be used to protect a complete building structure. A material 20 of fire resistant sheet material is stored on the roof 12 of building 10 near its peak 12 preferably as a coil as shown. Material 20 has opposing lateral edges 22, one of which is shown in FIG. 1. The lateral edges 22 extending between a proximal edge 24, and a distal pocket 26 (FIG. 2) that is formed of material 20. The proximal edge 24 is secured to roof 12 at a position above the ground surface 15 and preferably in a position adjacent to peak 14 as shown. Pocket 26 is located centrally within the coil as shown in FIG. 1 and this defines a retracted, rolled-up state of material 20. A deployment restrictor 30 is fastened to roof 12, and is secured around the coil thereby inhibiting its deployment. The deployment restrictor is preferably a simple strap, such as a plastic strap, that is calibrated for breaking when a selected tension force is applied to it.

Figure 2:
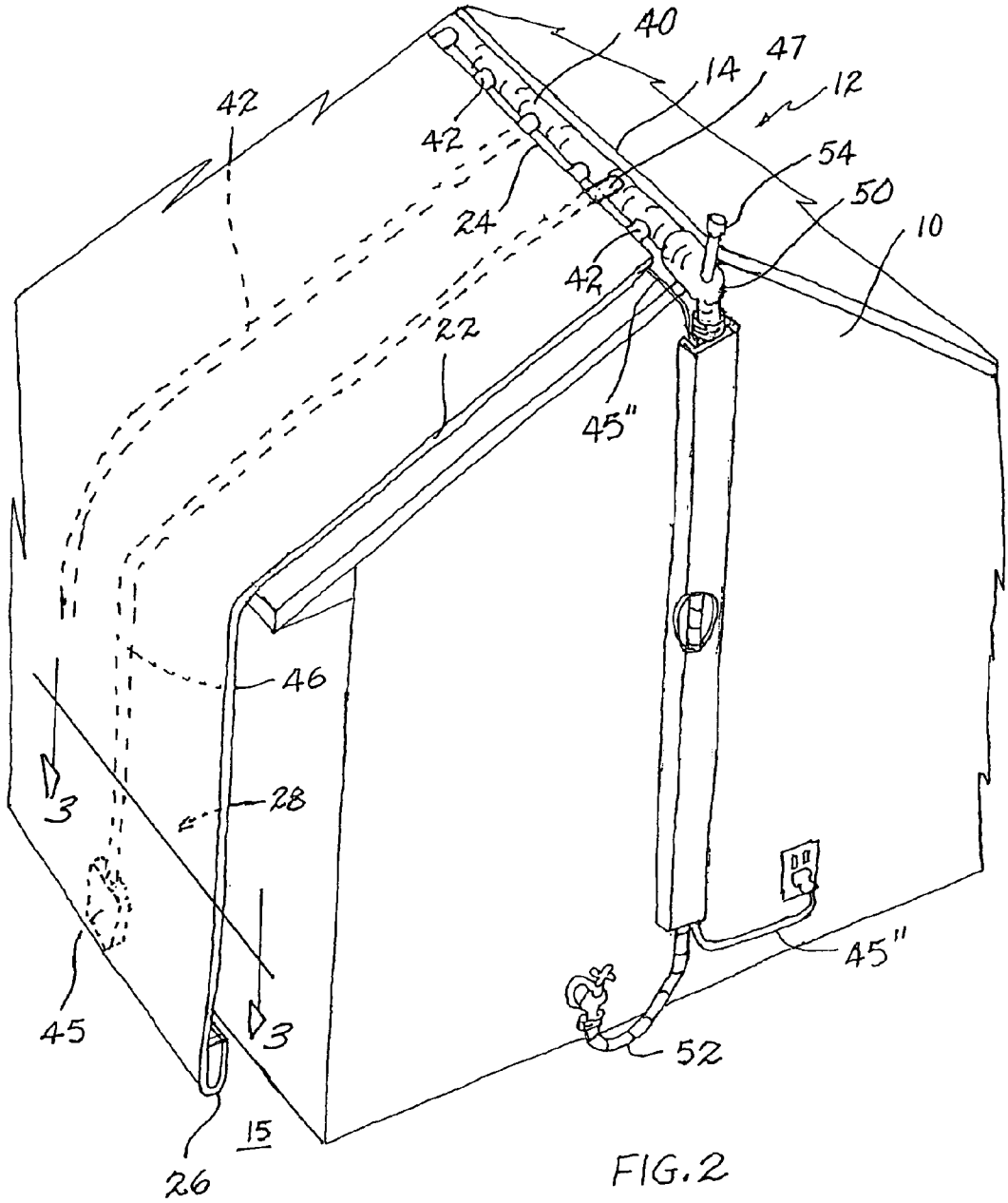
FIG. 2 is a perspective view of the portion of the building showing the presently described apparatus in its deployed state.

Referring now to FIG. 2, we see that the coil of material 20 is deployed and covers one portion of roof 12 to its edge, and also hangs from the edge so that pocket 26 contacts the ground surface 15. Inside surface 28 of material 20 faces the building 10. As shown in FIGS. 1 and 2, a manifold 40 is secured to roof 12 in a position parallel to the proximal edge 24. For clarity, fastening devices for securing the proximal edge 24 and the manifold 40 in place on roof 12 are not depicted in the figures, but such fastening is considered to require only routine mechanical skills for selection and installation. A plurality of spaced apart sprayer hoses 42 are each joined at one end thereof with the manifold 40 and these sprayer hoses 42 are joined to and extend along the inside surface 28, generally parallel to the lateral edges 22, and terminate within pocket 26. The sprayer hoses 42 are perforated with apertures 44 in such a manner that when these hoses 42 are filled with water under pressure, water sprays through the apertures 44 onto the inside surface 28 of the material 20, and also onto the building 10. The dashed lines shown in FIG. 3 represent the directions of such spray.

Figure 3:
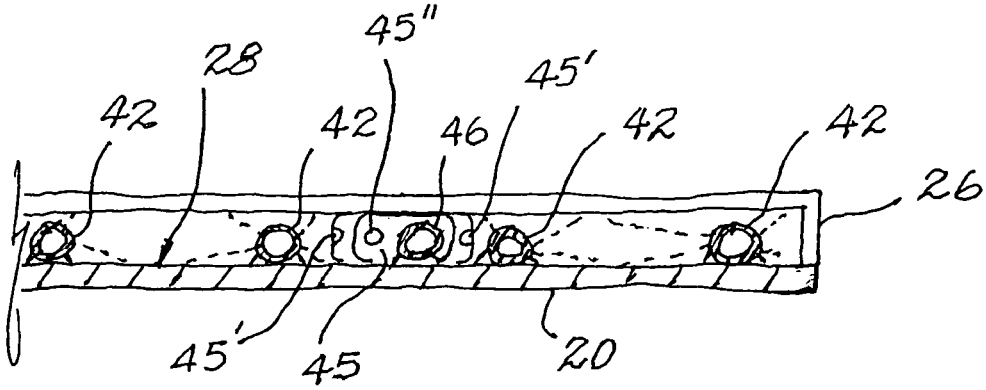
FIG. 3 is a cross-sectional view thereof taken along cutting line 3-3 in FIG. 2.

Referring now to FIG. 3, we see that sprayer hoses 42 terminate within pocket 26 so that any water not sprayed out of sprayer hoses 42, falls into pocket 26. The weight of the water collected in pocket 26 helps to anchor the material 20 and hold it in place against the forces of winds that originate from an approaching fire or firestorm. A submersible pump 45 is secured within hem 26. Pump 45 has inlets 45' for suctioning the water in pocket 26 and return hose 46 delivers this water back to manifold 40 through a one-way valve 47 which is shown in FIG. 2. Pump 45 is powered by an electrical cord 45" which is secured to the inside surface 28 and which unrolls with the material 20. Electrical cord 45" originates at an exterior outlet as shown in the figures.

It is clear that a plurality of sprayer hoses 42 are required in order to provide enough water for protecting material 20 from the heat of an impinging fire, as well as to protect building 10 over any practical length of the building surface that is addressed with the present invention. Also, in order to return the water that is collected in pocket 26 to manifold 40 and averting overflow at pocket 26, multiple pumps 45 and return hoses 46 are required as well. The number and sizes of the various water conduits addressed in this invention is left to the routine mechanic to determine for each particular building and potential level of fire hazard. It should be realized that the sprayer hoses 42, and the return hoses 46 when not filled with water are able to be flattened so that material 20 and the hoses and the electrical feed wire 45" can be compactly wound into coils, such as the coil shown in FIG. 1.

As shown in FIGS. 1 and 2, an outlet port of a temperature controlled flow valve 50 is engaged with the manifold 40 and this valve 50 is normally closed. Connected on the inlet side of valve 50 is a means for delivering water under pressure to the flow valve 50. This water delivery means 52 may be a hose or other device capable of providing a pressurized water supply. Flow valve 50 is held closed by a sensor-actuator 54, either a heat-sensitive glass bulb or a two-part metal link held together with a fusible allow, as are used in fire sprinkler systems. The glass bulb or link applies pressure to a pip cap which acts as a plug preventing water from flowing through valve 50 until the ambient temperature around the sensor-actuator 54 reaches a chosen temperature indicative of fire encroachment. Because each valve 50 used on a particular portion of building 10 activates independently when a predetermined heat level is reached, the number of valves 50 that operate at any one time can be limited to only those nearest the fire, thereby maximizing the available water pressure at the most critical locations around the building 10. Sensor-actuator 54 is typically triggered by hot gases evolved by an approaching fire, but may also be triggered by direct radiant heat from nearby flames. It is noted that the sensor 54 is located in an elevated position where heat from an outdoor space heater or barbeque, for instance, will not cause an unwanted triggering of the fire protective system.

Figure 4:
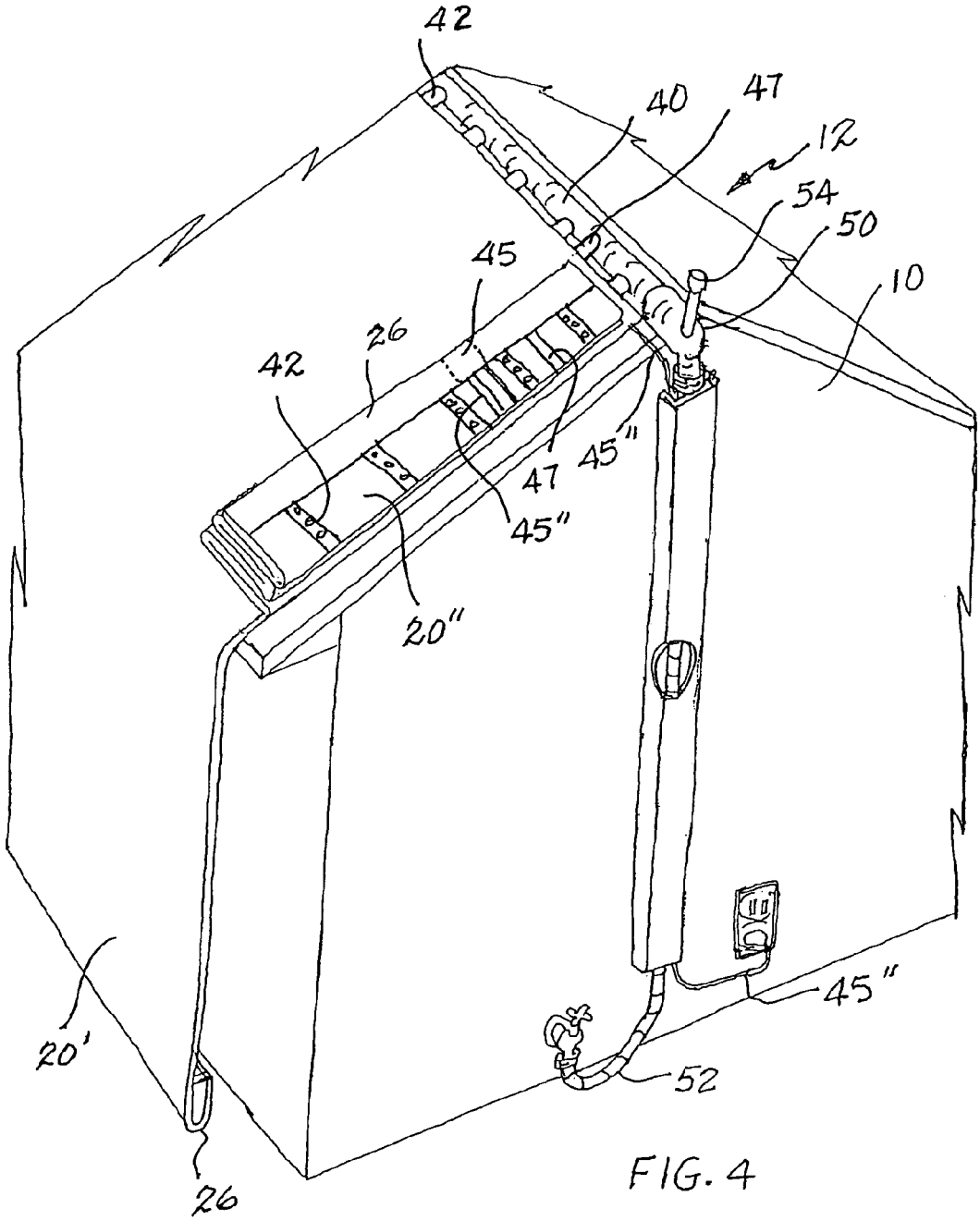
FIG. 4 is a perspective view of the portion of the building showing a further embodiment of the presently described apparatus in a partially deployed state.
Figure 5:
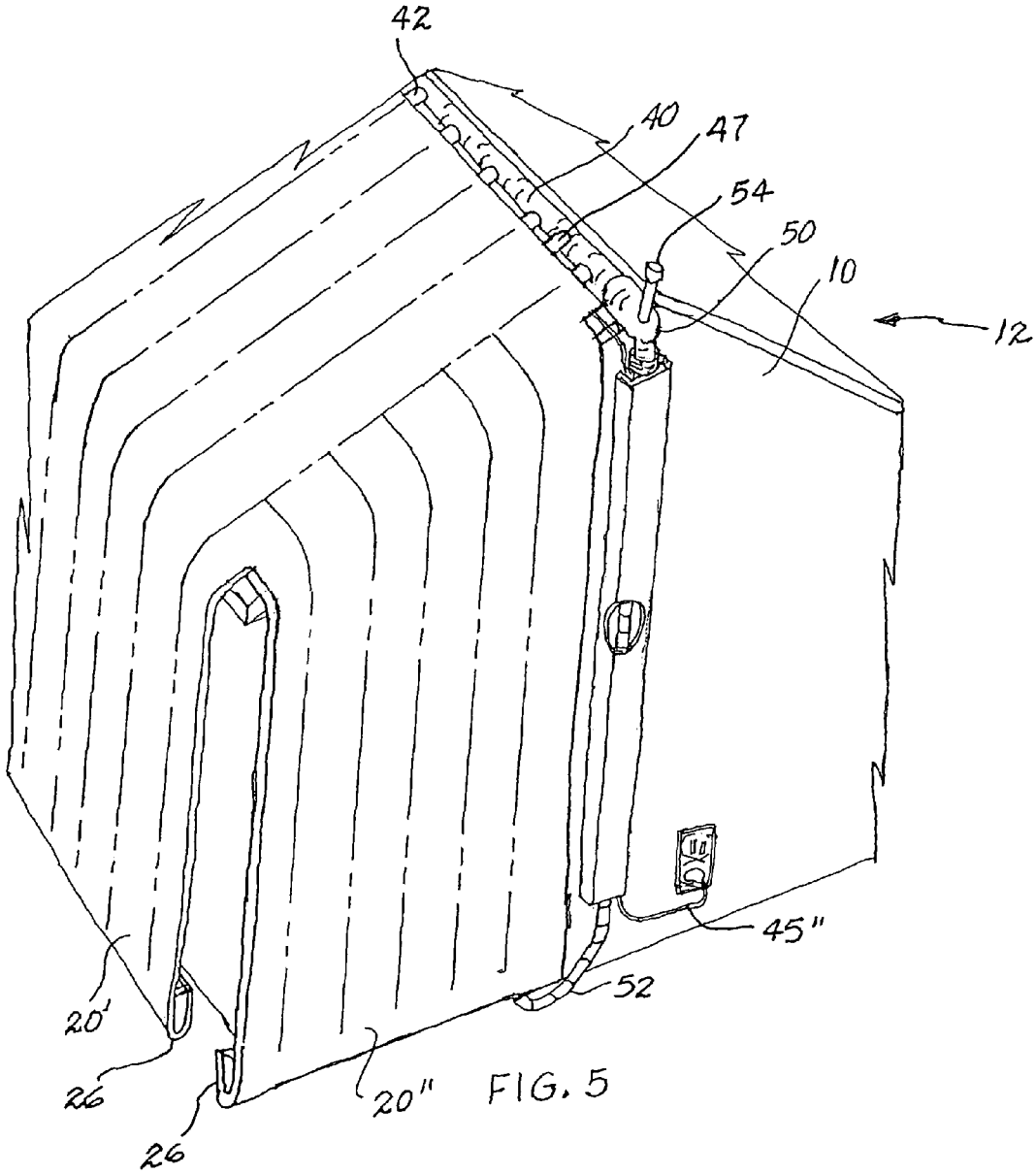
FIG. 5 is a perspective view of the portion of the building showing the embodiment of FIG. 4 fully deployed.

In FIGS. 4 and 5 the material 20 previously discussed and shown in FIGS. 1-3 is now referred to as material 20'. In a further enablement of the present invention, as shown in FIGS. 4 and 5, in order to automatically cover an adjacent side of building 10, a further portion 20" of material 20 may be folded as shown in FIG. 4 and rolled up into the coil illustrated in FIG. 1. This is possible since the material 20 utilized in this invention is able to be quite thin, i.e., light gauge, notably because with constant water cooling, a bulky, heavy and thick material is unnecessary. When deployed, material portion 20" falls to one side of portion 20' and covers a side of building 10 that is not covered by portion 20'. This is illustrated in FIG. 5 wherein each of the sprayer hoses 42 that are engaged with the inside surface 28 of material 20 (20' and 20") are represented by phantom lines. It is noticed that the sprayer hoses 42 that are engaged with material portion 20" feed from one of the sprayer hoses 42 of portion 20'. This particular sprayer hose 42 might be of a larger diameter so as to assure proper spraying of it and its dependents.

With respect to deployment of material 20, as soon as valve 50 opens, water pressure causes water to flood the manifold 40 and then apply water pressure to the sprayer hoses 42. This water pressure immediately starts the roll of material 20 to expand which breaks the deployment restrictor 30 freeing the roll of material 20 to start unrolling downwardly on roof 12. When folded material portion 20" is uncovered, as shown in FIG. 4, the water pressure driven into the sprayer hoses 42 in portion 20" causes the folded material to straighten and then fall over the side of the roof 12 into the position shown in FIG. 5. All of the elements defined for portion 20' also exist and are functional for portion 20" including a second pocket 26, submersible pumps 45, return hoses 46 and power cord 45".

The enablements described in detail above are considered novel over the prior art of record and are considered critical to the operation of at least one aspect of the apparatus and its method of use and to the achievement of the above described objectives. The words used in this specification to describe the instant embodiments are to be understood not only in the sense of their commonly defined meanings, but to include by special definition in this specification: structure, material or acts beyond the scope of the commonly defined meanings. Thus if an element can be understood in the context of this specification as including more than one meaning, then its use must be understood as being generic to all possible meanings supported by the specification and by the word or words describing the element.

The definitions of the words or drawing elements described herein are meant to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements described and its various embodiments or that a single element may be substituted for two or more elements in a claim.

Changes from the claimed subject matter as viewed by a person with ordinary skill in the art, now known or later devised, are expressly contemplated as being equivalents within the scope intended and its various embodiments. Therefore, obvious substitutions now or later known to one with ordinary skill in the art are defined to be within the scope of the defined elements. This disclosure is thus meant to be understood to include what is specifically illustrated and described above, what is conceptually equivalent, what can be obviously substituted, and also what incorporates the essential ideas.

The scope of this description is to be interpreted only in conjunction with the appended claims and it is made clear, here, that each named inventor believes that the claimed subject matter is what is intended to be patented.

What is claimed is:

1. An automated fire protective system for a house having a peaked roof, the system comprising:

a coil of a fire resistant, sheet material, the sheet material having an outside surface and an opposing inside surface;

a first portion of the sheet material having a longitudinally spaced apart proximal edge positioned exterior to the coil, and a distal edge central to the coil, the distal edge formed as a first pocket;

a sprayer hose fixed to the inside surface and extensive between an inlet valve at the proximal edge and the first pocket;

wherein, with the proximal edge fixed adjacent to a top of the peaked roof, the sheet material, when uncoiled, is sufficient to cover a portion of the peaked roof and a first side of the house;

wherein, when the sprayer hoses not filled with water are able to be flatten so that sheet material and hoses can be compactly wound into coils;

wherein an extension of the sprayer hose is fixed to the inside surface of the second portion of the sheet material terminating in a second pocket formed at a terminal edge of the second portion of the sheet material.

2. The automated fire protective system of claim 1 further comprising a second portion of the sheet material, the second portion of the sheet material folded accordion style and positioned within the coil.

3. The automated fire protective system of claim 2 wherein with the first portion of the sheet material uncoiled the second portion of the sheet material, when unfolded, extends laterally from the first portion of the sheet material for covering a second side of the house when the uncoiled first portion of the sheet material is positioned adjacent to a side of the peaked roof.

4. The automated fire protective system of claim 1 further comprising submersible pumps secured within the first and the second pockets, return hoses engaged between the submersible pumps and the inlet valve of the first sprayer hose.

5. The automated fire protective system of claim 4 wherein the inlet valve is temperature set point operated.

* * * * *